US005704102A

United States Patent [19]

Catallo

[11] Patent Number: 5,704,102

[45] Date of Patent: Jan. 6, 1998

[54] APPARATUS FOR FINISHING A FABRIC WEB

[76] Inventor: Frank Catallo, 75 Channel Dr., Port Washington, N.Y. 11050

[21] Appl. No.: 508,303

[22] Filed: Jul. 27, 1995

Related U.S. Application Data

[63] Continuation-in-part of Ser. No. 494,836, Jun. 26, 1995, abandoned.

[51] Int. Cl.[6] ..... D06C 21/00

[52] U.S. Cl. ..... 26/18.6

[58] Field of Search ..... 26/18.5, 18.6, 26/20; 28/155, 165; 162/280, 111, 361

[56] References Cited

U.S. PATENT DOCUMENTS

| | | | |
|---|---|---|---|
| 2,078,904 | 4/1937 | Cluett | 26/18.6 |
| 2,120,536 | 6/1938 | Woodhead | 26/18.6 |
| 2,262,268 | 11/1941 | Chatfield | 26/18.6 |
| 2,335,313 | 11/1943 | Rowe et al. | 26/18.6 |
| 2,368,637 | 2/1945 | Bruenner et al. | 26/18.6 |
| 2,522,663 | 9/1950 | Chatfield | 26/18.6 |
| 2,825,117 | 3/1958 | Evans et al. | 26/18.6 |
| 2,979,131 | 4/1961 | Bentov | 26/18.6 |
| 3,007,223 | 11/1961 | Wehrmann | 26/18.6 |
| 3,195,210 | 7/1965 | Wehrmann | 26/18.6 |
| 3,195,211 | 7/1965 | Wehrmann | 26/18.6 |
| 3,339,249 | 9/1967 | Libby | 26/18.6 |
| 3,471,363 | 10/1969 | Schmidt | 26/18.6 |
| 3,832,758 | 9/1974 | Johnson | 26/18.6 |
| 3,866,277 | 2/1975 | Hojyo | 26/18.6 |
| 3,940,833 | 3/1976 | Troope et al. | 26/18.6 |
| 3,954,557 | 5/1976 | Heim et al. | 26/18.6 |
| 4,003,783 | 1/1977 | Groome et al. | 26/18.6 |
| 4,088,731 | 5/1978 | Groome | 26/18.6 |
| 4,575,909 | 3/1986 | O'Brien et al. | 26/18.6 |
| 5,412,853 | 5/1995 | Catallo | 26/18.6 |

FOREIGN PATENT DOCUMENTS

| | | | |
|---|---|---|---|
| 911248 | 5/1954 | Germany | 26/18.6 |
| 5013396 | 4/1969 | Japan | 26/18.6 |
| 727569 | 4/1955 | United Kingdom | 26/18.6 |
| 957279 | 5/1964 | United Kingdom | 26/18.6 |
| 1009201 | 11/1965 | United Kingdom | 26/18.6 |
| 2031040 | 4/1980 | United Kingdom | 26/18.6 |
| 94/28227 | 12/1994 | WIPO | 26/18.6 |

*Primary Examiner*—Amy B. Vanatta
*Attorney, Agent, or Firm*—Leo Fornero

[57] ABSTRACT

An apparatus for finishing or shrinking webs of material such as textile webs, both of the knit and woven variety; and non-woven like webs, all usually made from fibrous like materials. The apparatus, generally comprises first and second roll like members. One is capable of being driven faster than the other and both are disposed to drive belts for moving the web. The apparatus also includes a compaction or finishing zone formed between the belts by an adjustably disposed idle roll like member and one of the roll like members. The plural belts are disposed to run around the roll like members so that a web may be fed on a sheet like member to facilitate finishing or shrinkage of the web in the finishing or compaction zone formed between the belts which are caused to abut each other by roll like members disposed inside the abutting belts. The sheet like member being disposed relative the zone so that treatment of the web in said zone is optimal.

4 Claims, 4 Drawing Sheets

APPARATUS FOR FINISHING A FABRIC WEB

This is a continuation-in-part of application Ser. No. 08/494,836, filed Jun. 26, 1995, now abandoned.

BACKGROUND OF THE INVENTION

In the finishing of fibrous web materials such as are commonly utilized in the manufacture of textile like fabrics it is customary to compact the fabric or process same to achieve a more desirable hand and/or finish.

This invention relates to an apparatus for finishing and/or compacting such webs to achieve such a result.

A number of approaches have been developed whereby a desired compaction is realized to reduce the shrinkage propensity of such webs or finish same in order to achieve a desirable hand, look or drape.

One such device is shown in U.S. Pat. No. 5, 412,853 to Catallo wherein the web is processed in an apparatus utilizing abutting belts to shrink or finish the web.

Another such arrangement is shown in the Wehrmann U.S. Pat. No. 3,007,223 where a tube of fabric is shrunk in an apparatus having a spreader extending into the belts to cause shrinkage of the fabric disposed between the spreader and belt as the belts curve around the rolls.

Also U.S. Pat. No. 2,522,663 teaches the use of belts moving in a curved path to shrink fabric. The processing of the fabric is accomplished in a direction lengthwise of the web or wales of same to permanently compact the fabric making it less likely that it will shrink in its end use state.

The compaction is achieved in the fabric by moving it between cooperating belts which function to maintain the fabric in its shrunk condition after it passes through the portion of curvature at the entrance end of the machine.

Having the foregoing and other considerations in mind the invention contemplated herein discloses an apparatus which is efficient in its purpose of finishing or compacting webs of fibrous materials and also is simple to operate and effective in achieving the end results desired.

In certain operations it is desirable to arrange a sheet like member so that it feeds the web into the compaction or finishing zone at the entry end of said zone and for other operations the sheet like material may be disposed either before or inside the zone.

It is also contemplated to provide a compaction or finishing zone wherein the belts in the zone move at the same speed to thereby substantially eliminate the damaging rubbing which occurs when the periphery of one belt moves faster than that of the cooperating other belt. Such rubbing causes different surface and wear affects on the fabric being processed and premature belt wear.

It is also intended and I have now established that a compaction or finishing zone may be formed by a system comprising a belt wrapped around a driving roll member and an idle roll. The compaction zone is formed by another idle roll pressing against the belt as it runs over the driving roll. The idle roll my be felt covered to optimize the shrinkage or finishing that occurs in said zone. Also it is important that this other idle roll be smaller in diameter then the driving roll. As the small idle roll is adjusted relative the belt it my be set in this relationship to achieve a finishing zone that has the idle roll and the belt moving at about the same selected speed to create a variable speed retarding zone in said More particularly the speed relationship in the zone is achieved by moving the small idle roll against the belt to thereby change the outside surface of the belt—particularly the curvature—as it passes over the driving roll to cause the change of speed to occur in the compaction or finishing zone which permits you to control the amount of compaction.

Other benefits of the present invention will emerge from the more detailed description which follows and to the accompanying drawings.

BRIEF DESCRIPTION OF THE DRAWINGS

In the drawings wherein like reference characters denote corresponding parts through the several views.

GENERAL DESCRIPTION OF THE INVENTION

Figure 1:
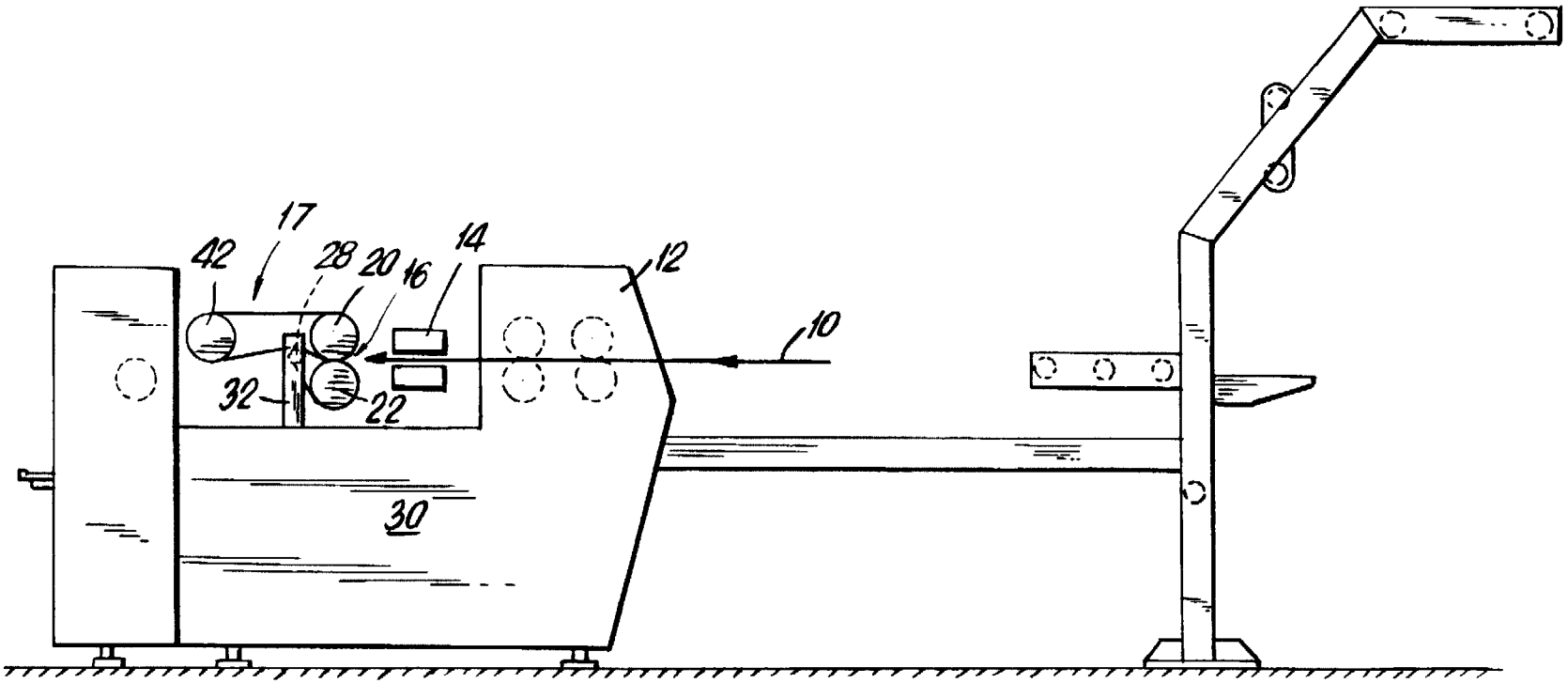
FIG. 1 is a diagrammatic side view of the apparatus for finishing a web.

Broadly according to the present invention an apparatus is provided for compacting a web of fibrous material to achieve shrinkage control of such a web or, if improvement in the hand, drape or appearance are desired, this can also be accomplished through finishing techniques utilizing the apparatus in its various forms.

Usually the web 10 in a slightly wet state, as it is moved through a steamer 12, is conditioned in chamber 14 enters the entrance end 16 of the apparatus, generally designated 17, which includes an upper roll 20 and a lower roll 22 which operate to drive the belts 24 and 26. These rolls which are movable may be driven through the usual variable speed drives, not shown. The upper belt 24 may be driven at a faster speed than the lower belt 26 as will be described in more detail hereinafter. The web 10 is disposed to run between belts 24 and 26.

Figure 2:
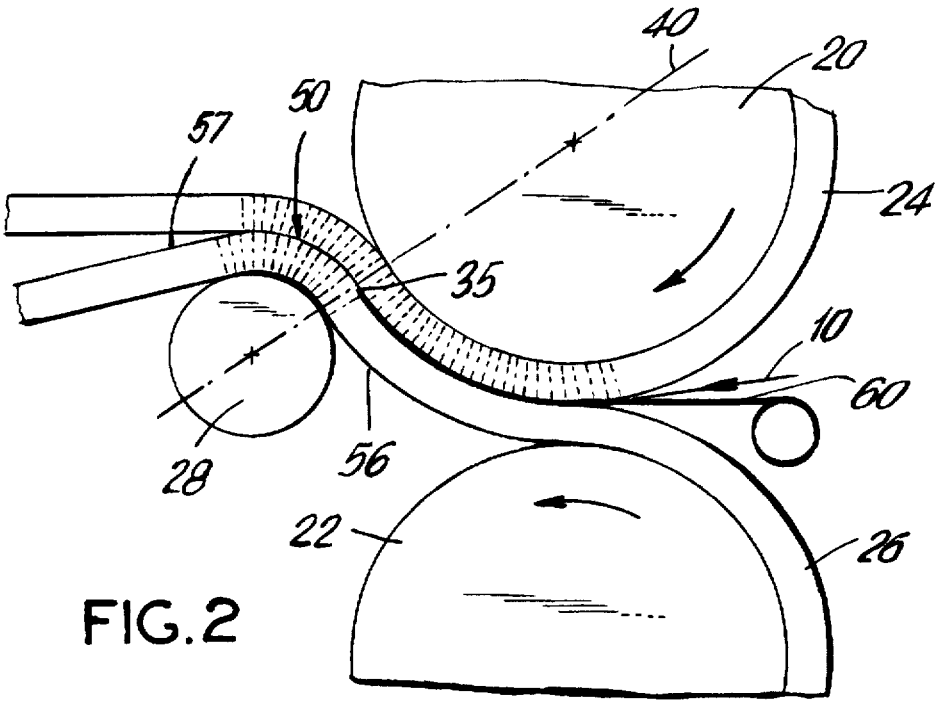
FIG. 2 is an exploded partial diagrammatic view showing the entry end of the apparatus and the finishing zone.
Figure 3:
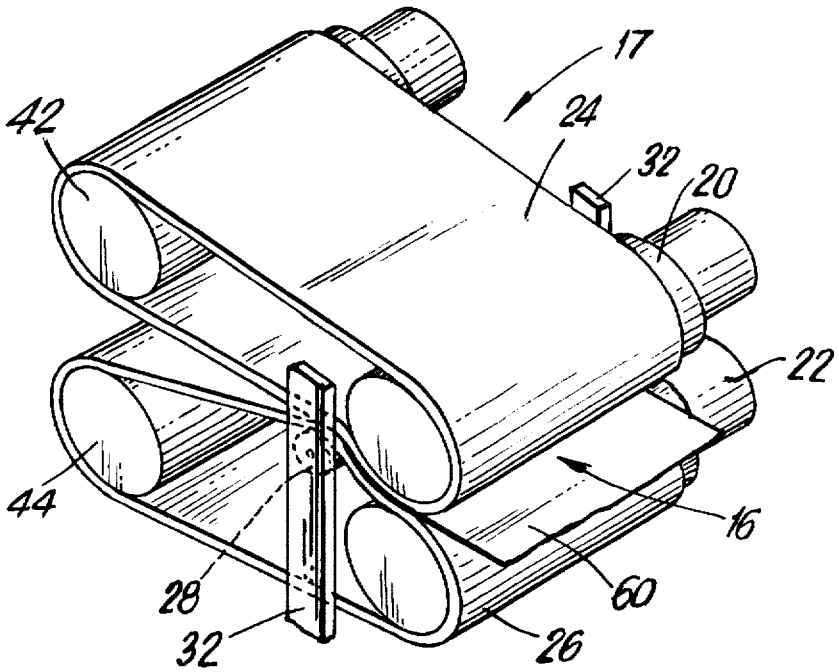
FIG. 3 is a perspective view of one type of finishing apparatus for treating a web.
Figure 4:
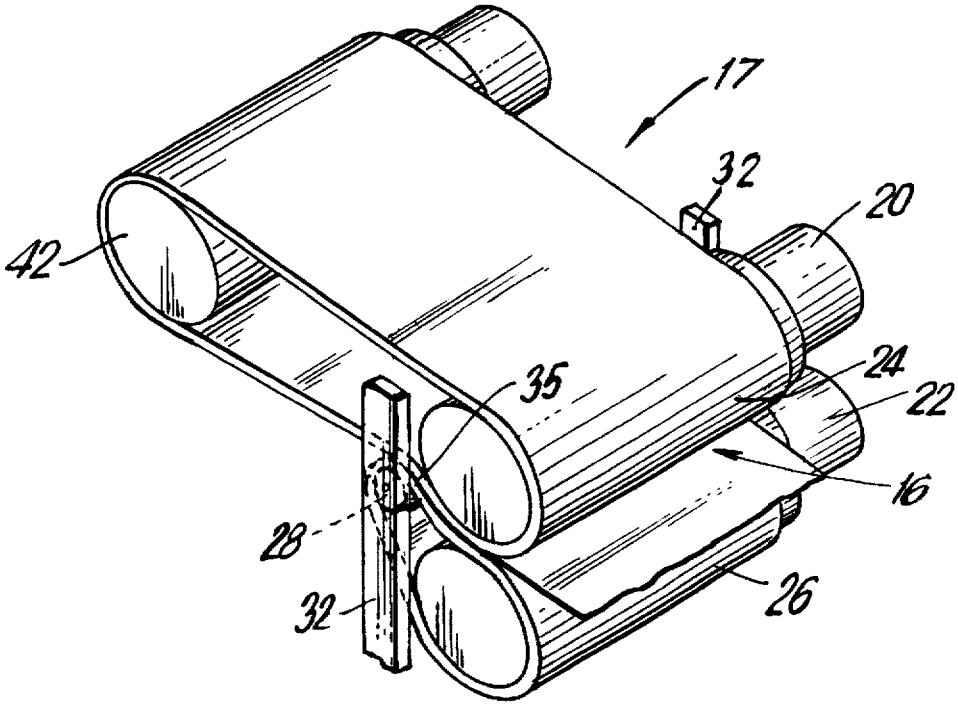
FIG. 4 is another type of finishing apparatus for treating a web.

In FIG. 2 there is shown an idle roll 28 adjustable mounted on the frame 30 in any well known fashion, as by beam 32 mounted on both sides of the frame as shown diagrammatically in FIGS. 3 and 4. In this fashion it is possible to cause the roll 28 to press against the lower belt 26 to cause a nip 35 to occur, usually on the centerline 40 running through the centers of the roll 20 and the idle roll 28.

In this fashion there occurs, as is shown in FIG. 2, a curvature of belt 24 as it runs around the roll like member 20 and a cooperating curvature of belt 26 as it runs around the roll like member 22. In one form of the invention idle roll like members 42 and 44 are provided for the belts to move around but, as shown in FIG. 4 the idle roll 28 may be utilized to support the belt and in this fashion the web 10 is more quickly removed from its contact with the belts as it moves out of the compaction or finishing zone 50 formed between the belts 25 and 26 and in the vicinity of the centerline 40. As will be clear from FIG. 4 a system is shown wherein roll like member 44 is not utilized and in its place the roll 28 functions as the belt support.

More particularly FIG. 2 shows what happens when the belts 24 and 26 of a substantial thickness for such belts, 1 inch as an example, are curved over a relatively small diameter roll 28. The outer layer 57 of the belt will stretch while the inner layer 56 will compress relative to the thickness of the belt material and the radius over which it is curved. If, as is shown in FIG. 2 a second belt is curved over the stretched portion of the cooperating belt the inner surface of the second belt 24 will compress resulting in a substantial difference in the circumferential length of both belts where they are sandwiched together. This occurs normally in the zone 50.

As is shown in FIG. 3 and FIG. 4 endless belts 24 and 26 travel together over an idle roll like member 28, the inner surface 56 of belt 26 shown in FIG. 2 will assume the speed of the surface speed of roll like member 22 and the outer surface's 57 speed will be faster depending on the thickness of the belt 26. The inner surface of belt 24 will assume a speed somewhat slower than the outer surface speed of belt 26 and also considerably slower than the speed of the belts if they were not curved.

However, the difference in speed of the outer surface of belt 26 and the inner surface of belt 24 in the compaction or finishing zone 50 is non-productive and only contributes to excessive wear on the belts unless the speed of either belt is changed to match the speed of the other belt in the compaction zone 50. It is preferable to slow the speed of the belt 26 to achieve a nearly equal speed of the belts 24 and 26 in the compaction or finishing zone 50. In this fashion you reduce significantly the wear affects that different speeds of the belts have on webs being processed in the compaction zone 50.

In FIG. 2 a sheet like member 60 is fashioned to run across the width of the apparatus as is shown in FIG. 3 and may be adjustably inserted into the vicinity of the compaction zone 50 and functions to permit driving of the web, which passes between the sheet like member 60 and the belt 24, at a faster speed to the zone 50.

Also the sheet like member 60 operates to reduce the affect created on the web resulting from the different belt speeds which are contemplated herein in order to achieve the same belt speeds in the zone 50.

Figure 5:
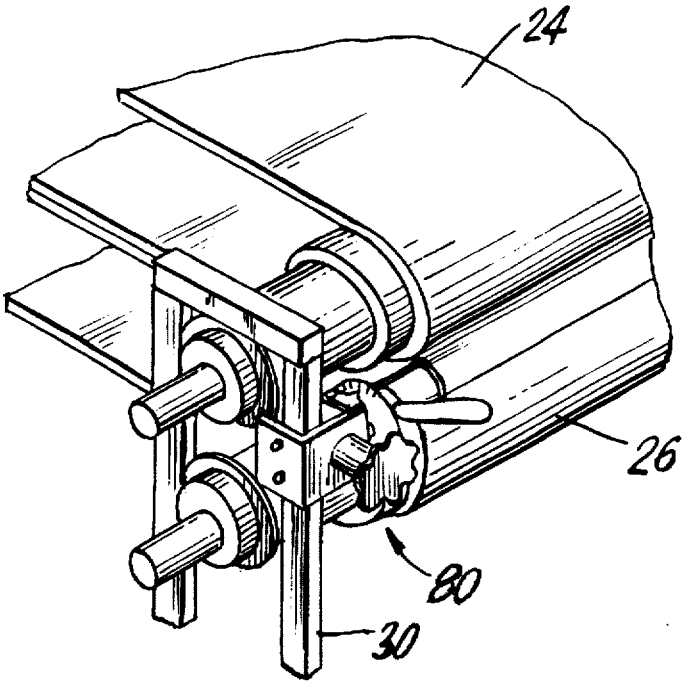
FIG. 5 is a partial view of the entry end of the apparatus contemplated herein including an adjustment mechanism for moving the sheet as desired in the finishing zone or in its vicinity.

An adjustable member 80 is shown in FIG. 5 and is connected to the thin sheet like member 60. This connection is across the entire width of the member 60 and not only provides for adjustment in the vicinity of the finishing zone 50 but is made to provide a degree of stiffness to the sheet member 60 in any well manner.

Also it will be understood that the sheet like member 60 may disposed in various different locations the only limitation being that it is disposed relative the compaction or finishing zone 50 as discussed hereinabove A dipping, as shown in FIG. 4, of the belt 26 away from the zone 50 is contemplated so that the belt 26 does not cause a stretching of the web 10 as it exits from the finishing zone 50. An alternative is shown in FIG. 3 wherein the idle roll 28 serves to function as a support for belt 26 and eliminates the need for roll 44.

Figure 6:
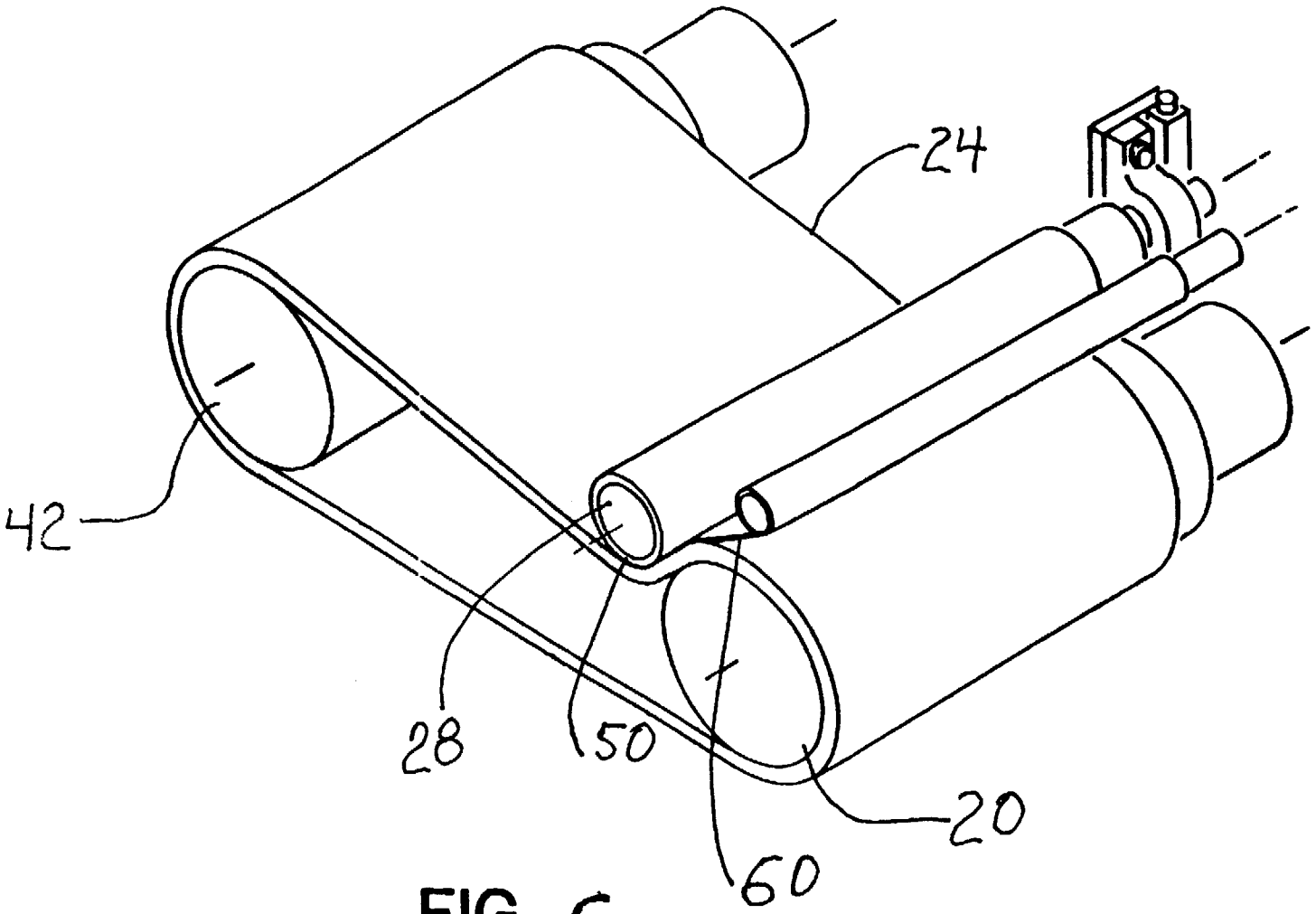
FIG. 6 is a partial view of another form of the apparatus for treating a web.

In FIG. 6 there is shown another form of the invention contemplated herein. A driving roll designated 20 disposed at one end 16 and an idler roll 42 at the other end of the apparatus serve to support belt 24. A second idle roll 28 of substantially smaller diameter than the driving roll 20 adjustably supported as described hererinabove is arranged relative the belt 24 so that the curvature of the belt may be changed in the vicinity of the zone 50 to cause the belt 24 to slow down in the zone as desired. Also just prior to entering the compaction zone which acts as a retarding zone the web moves at a faster rate of speed in what is referred to as a web feed zone. To facilitate feeding of the web from the feed zone to the retarding or finishing zone a thin sheet like member 60 is also provided for and operates as is described above.

It should be understood of course that specific forms of the invention herein illustrated and described are intended to be representative only as certain changes may be made in the invention without departing from the clear teachings of the disclosure. Accordingly, reference should be made to the following appended claims which determine the full scope of the invention.

I claim:

1. Apparatus for finishing a web of material and said apparatus having an entry end and an exit end whereby the web enters into said apparatus and is discharged therefrom and comprises:

a) an upper movable roll for said apparatus;

b) a lower movable roll for said apparatus;

c) one of said rolls capable of being driven at a faster speed than the other roll;

d) an idle roll for said apparatus which is adjustably disposed relative one of said movable rolls as desired;

e) an other roll disposed to cooperate with said upper roll;

f) an upper belt disposed to run around the upper roll and the other roll;

g) a lower belt disposed to run around the lower roll and the idle roll;

h) said idle roll cooperating with one of said rolls to form a compaction zone between said belts by moving said idle roll so that it presses one of said belts against the other belt to cause said belts to form a web entrance to said compaction zone and a web exit from said compaction zone having a nip therebetween for web compaction;

i) said compaction zone forming a retarding zone wherein web compaction occurs and includes an entrance for said web and an exit, said web being compacted between said entrance and exit and at a location that is determined by the size of the rolls used;

j) a sheet positioned in the retarding zone between the entrance end and the exit end in the retarding zone.

2. The apparatus of claim 1 wherein an adjusting means is connected to the said sheet so that the sheet's position relative the compaction zone may be set as desired.

3. The apparatus of claim 1 wherein a finishing zone is formed between the upper and lower belts by moving the idle roll so that it presses the lower belt against the upper belt to cause said belts to form a web entrance to said finishing zone and a web exit from said zone and said sheet being disposed relative said zone to guide said web into the web entrance.

4. The apparatus of claim 1 wherein an adjusting means is connected to said sheet so that its position relative a centerline passing through said idle roll and said upper movable roll may be set as desired to enhance web compaction.

* * * * *